US006371329B1

(12) United States Patent
Wild

(10) Patent No.: US 6,371,329 B1
(45) Date of Patent: Apr. 16, 2002

(54) RECLOSABLE DRINKING STRAW

(75) Inventor: Hans-Peter Wild, Zug (CH)

(73) Assignee: Indag Gesellschaft Fur Industriebedarf Mbh & co., Heidelberg (DE)

( * ) Notice: Subject to any disclaimer, the term of this patent is extended or adjusted under 35 U.S.C. 154(b) by 0 days.

(21) Appl. No.: 09/690,362

(22) Filed: Oct. 17, 2000

(30) Foreign Application Priority Data

Oct. 29, 1999 (DE) ..... 299 19 069 U

(51) Int. Cl.[7] ..... B65D 47/12
(52) U.S. Cl. ..... 220/705; 239/33; 215/388
(58) Field of Search ..... 220/706, 705, 220/703; 339/33; 215/388; 229/103.1

(56) References Cited

U.S. PATENT DOCUMENTS 2,877,918 A 3/1959 Gardner
D318,427 S * 7/1991 Sherburne, Jr. ..... 220/705
5,048,709 A 9/1991 Alverson
D324,824 S * 3/1992 Hansen ..... 220/705
D327,848 S * 7/1992 Hanover ..... 220/705
5,328,069 A * 7/1994 Cohanfard ..... 220/705
5,462,194 A 10/1995 Barnwell

FOREIGN PATENT DOCUMENTS

DE 19525620 1/1997
GB 2 067 979 1/1980

* cited by examiner

*Primary Examiner*—Joseph M. Moy
(74) *Attorney, Agent, or Firm*—Marshall, Gerstein, & Borun

(57) ABSTRACT

A reclosable drinking straw for flexible or semi-flexible beverage containers including a pot-like closure cap externally mounted on a drinking straw end to be axially displaced between a closed position and an open position, the inner cap bottom portion being designed as a closing element for the drinking straw openings, and the cap wall comprising at least one lateral passage opening which in the open position is in flow communication with the drinking straw opening.

9 Claims, 1 Drawing Sheet

RECLOSABLE DRINKING STRAW

FIELD OF THE INVENTION

The present invention relates to a reclosable drinking straw, DE-A-195 25 620 discloses an opener in the form of a tubular connecting sleeve for a cardboard packaging, the opener including an inner passage for the liquid and a free end which has seated thereon a detachable closure cap. A drinking straw with its drinking straw end and the drinking straw opening can be inserted into the passage of the opener. The drinking straw can be closed indirectly by the closure cap, i.e., the technically expensive opener which is not absolutely necessary for most beverage bags or beverage cardboard packings is imperative for the closing function. Such a construction is technically troublesome and expensive.

BACKGROUND OF THE INVENTION

It is the object of the present invention to provide a reclosable drinking straw, in particular for flexible or semi-flexible beverage containers, which is simple with respect to the technical manufacturing process and inexpensive and can comfortably be handled, i.e. very easily.

SUMMARY OF THE INVENTION

Expediently, a snap connection is provided between the closure cap and the end of the drinking straw in order to define the respective positions of the closure cap and also to let said positions be felt by the user. Both end positions of the closure cap can be defined by snap connections.

Expediently, the inner diameter of the closure cap close to the bottom of the cap is matched with the outer diameter of the mouth of the drinking straw such that in the closer position not only the bottom of the cap is taken for the closure function but, so to speak, the mouth of the drinking straw sealingly fits into the region of the bottom of the cap. Even in case of interior pressure a reliable closure function can be achieved.

Expediently two counter engaging elements and one engaging element or two engaging elements and one counter engaging element can be provided which co-operate or alternatively in order to define the positions of the closure cap at the end of the drinking straw.

BRIEF DESCRIPTION OF THE DRAWINGS DETAILED DESCRIPTION OF THE PREFERRED EMBODIMENT

Embodiments of the subject matter of the invention shall now be explained with reference to the drawing, in which.

A reclosable drinking straw T consists of a tubular drinking straw 1, preferably made from a plastic material, whose one drinking straw end 2 has molded thereon at an axial distance in front of the drinking straw opening 3 an engagement element E in the form of an outer annular bead 4, and of a pot-shaped closure cap K which from the start is captively put onto the drinking straw end 2.

Figure 1:
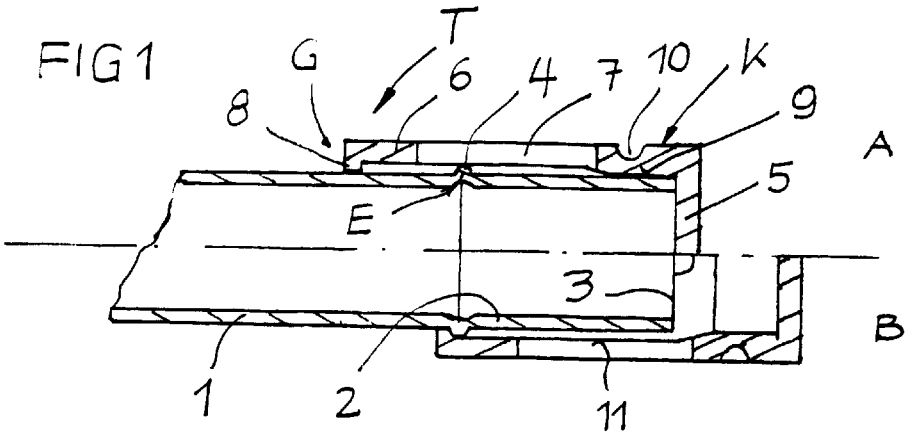
FIG. 1 shows a first embodiment of a reclosable drinking straw, namely in the upper half in the closed position and in the lower half in the open position.
Figure 2:
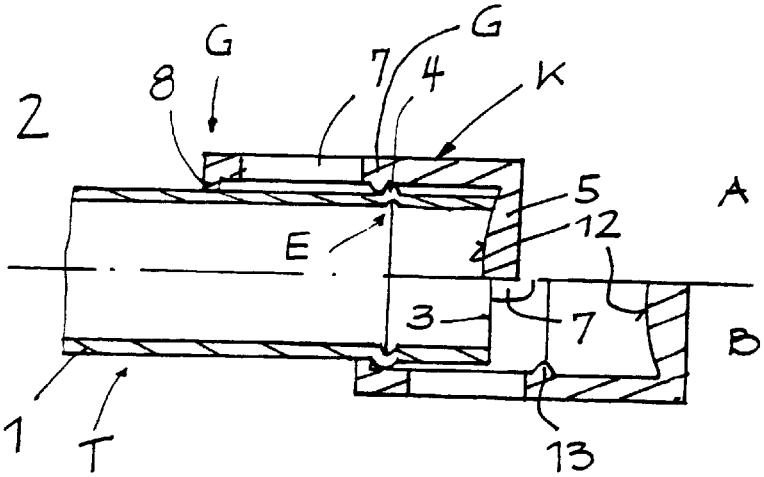
FIG. 2 is a longitudinal section through a further embodiment in the two end positions.

The closure cap K has a closed bottom portion 5 with an inner closure cap bottom 12 which is optionally curved inwards (FIG. 2). In FIG. 1 the bottom portion 5 is followed by a section 9 of the inner wall of the closure cap K whose inner diameter corresponds approximately to the outer diameter of the drinking straw opening 3. At a further distance from the bottom portion 5 the inner wall 11 of the closure cap K is designed with a larger diameter than the outer diameter of the drinking straw opening. The substantially cylindrical cap wall 6 of the closure cap K comprises circumferentially distributed passage openings 7, i.e. in the form of elongated holes. At the end of the closure cap K which faces away from the bottom portion 5, there is formed a counter-engagement element G, expediently in the form of an inwardly projecting annular bead or collar 8 which is slidable, for instance in a slight slide fit, on the outer circumference of the drinking straw end 2. The section 9 of the closure cap K may be formed by a groove pressed in from the outside. The axial distance between the bottom portion 5 and the counter-engagement element G is greater than the axial distance between the drinking straw opening 3 and the engagement element E.

According to FIG. 1, upper half, the closure cap K is first put onto the drinking straw end 2 until the counter-engagement element 8 slides over the engagement element E, which is ensured by the elasticity of the drinking straw 1 and/or the elasticity of the closure cap K, which expediently consists of plastics. When the closure cap in FIG. 1 is then further moved to the left, the drinking straw opening 3 will enter into the portion 9 until it finally comes to rest on the cap bottom 12. Although the passage openings 7 are permanently open to the outside, the drinking straw 1 is now closed.

For pouring or drinking purposes the closure cap K is axially moved from the closed position A, FIG. 1, upper half, into the open position B, FIG. 1, lower half, with the drinking straw opening 3 exiting from the section 9 and the counter-engagement element G being finally caught on the engagement element E. Moreover, the engagement element E is at least one outer annular bead 5. In the open position B a flow connection exists between the drinking straw opening 3 and the passage openings 7, so that liquid can be poured or drunk through the drinking straw 1.

In the embodiment shown in FIG. 2, and in contrast to the embodiment shown in FIG. 1, the section 9 of the closure cap K has been omitted although it could also be provided in this embodiment. By contrast, in addition to the counter-engagement element G, the closure cap K comprises at least one further counter-engagement element G in the form of an inner annular bead on the inner wall at the cap end and at the opposite side of the passage openings 7.

In the closed position A which is shown in FIG. 2 in the upper half, the central counter-engagement element G of the closure cap K is in positive and/or non-positive engagement with the engagement element E of the drinking straw 1 so that the cap bottom 12 is pressed against the drinking straw opening 3 and said opening is closed. The other counter-engagement element G ensures, for instance, the proper alignment of the closure cap on the drinking straw 1.

In the open position B which is shown in FIG. 2, lower half, the rear counter-engagement element G of the closure cap K grips behind the engagement element E of the drinking straw 1, and the cap bottom 12 is moved away from the drinking straw opening 3.

It should be noted that at least the closed position A should be defined as positive and/or non-positive. By contrast, the open position B or any open position need not necessarily be defined by a locking connection because the user can choose an open position just suiting him/her at any rate.

Figure 3:
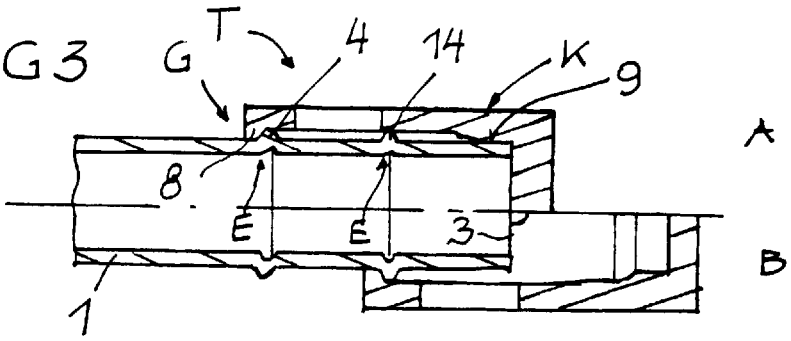
FIG. 3 is a longitudinal section through a further embodiment in the two end positions.

In the embodiment shown in FIG. 3, two axially spaced-apart engagement elements E, each in the form of an outer annular bead 4, are molded onto the drinking straw 1 while the closure cap K only comprises the counter-engagement element G at the end side in the form of an inner bead 8. The closed position A and the maximum open position B can clearly be defined. As shown, the closure cap K may be provided with a constricted section 9 for sealing the drinking straw opening 3 in an improved manner.

Figure 4:
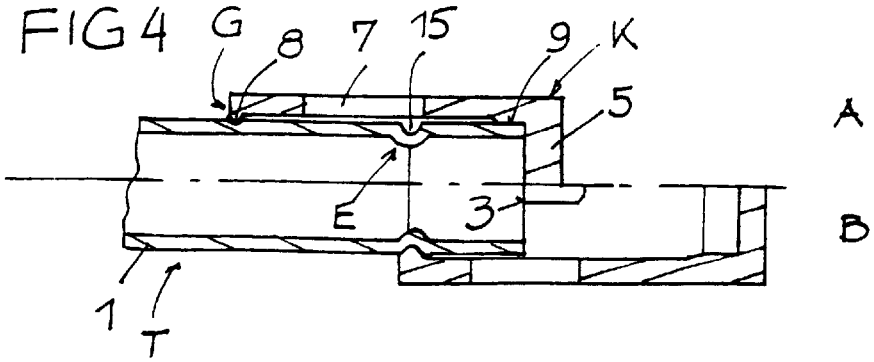
FIG. 4 is a longitudinal section through a further embodiment in the two end positions.

FIG. 4 shows an embodiment in which the engagement element E of the drinking straw 1 is a surrounding groove 15 into which the counter-engagement element of the closure cap K, which is formed as an inner annular bead 8, can snap for defining the maximum open position B. In the closed position A the counter-engagement element G optionally deforms the outer circumference of the drinking straw 1, on the one hand, in order to ensure a satisfactory alignment of the closure cap K with respect to the end of the drinking straw and, on the other hand, to support the holding effect of the section 9 at the end of the drinking straw.

By analogy with FIG. 3, a second engagement element E could also be formed in FIG. 4 in the form of an annular groove 15 into the end of the drinking straw.

The drinking straw T can be provided independently of any beverage container and is already equipped with the closure cap. Furthermore, the drinking straw with the attached closure cap can be mounted on the beverage container in the standard manner. Since the closure cap is only mounted on the end of the drinking straw itself, the drinking straw is pushed into or pulled out of the respective beverage container to such an extent as is considered to be convenient by the user. The attached closure cap has an additional safety function because an unintended complete sliding of the drinking straw into the beverage container is prevented. When the drinking straw is used with a bottle, the attached closure cap makes it possible to hold the drinking straw end at the bottle opening when the outwardly projecting edge of the closure cap is resting on the bottle opening.

I claim:

1. A reclosable drinking straw, in particular for flexible or semi-flexible beverage containers, comprising in combination a pot-like closure cap (K) externally mounted on a drinking straw end (2) to be axially movable between a closed position (A) and an open position (B), said pot-like closure cap having an inner cap bottom portion (5) designed as a closing element for the drinking straw opening (3), a cap wall (6) having at least one lateral passage opening (7) which in said open position (B) is in flow communication with said drinking straw opening, and an outwardly projecting edge adapted to engage the beverage container.

2. The drnking straw according to claim 1, and engagement and counter-engagement elements (E, G) which can be brought into a positive or non-positive locking connection provided on said drinking straw end (2) and said closure cap (K) for positionally securing and slidably guiding said closure cap (K) on said drinking straw end (2) and for defining at least one of said open and closed positions.

3. The drinking straw according to claim 2, wherein at least one said open position (B) and said closed position (A) can be defined by means of said engagement and counter-engagement elements (E, G).

4. The drinking straw according to claim 1, wherein the inner diameter of said closure cap in said cap bottom portion (5) corresponds approximately to the outer diameter of said drinking straw opening (3).

5. The drinking straw according to claim 2, wherein a said counter-engagement element (G) is provided in said closure cap (K) inside the cavity and at the side of the passage opening (7) facing away from said cap bottom (12), and that said engagement element (E) is provided on the outside of said drinking straw end (2) at a distance from said drinking straw opening (3), said distance being smaller than the axial distance between said counter-engagement element (G) and said closure cap bottom (12).

6. The drinking straw according to claim 5, wherein said counter-engagement element (G) is an inner annular bead (8) on the cavity wall of said closure cap (K) and each said engagement element (E) is an outer annular bead (4, 14) of said drinking straw end (2).

7. The drinking straw according to claim 2, wherein said closure cap (K) has two axially spaced-apart inner annular beads (8, 13) and said drinking straw end (2) has an outer annular bead (4).

8. The drinking straw according to claim 2, wherein said closure cap (K) has an inner annular bead (8) and said drinking straw end (2) has two axially spaced-apart outer annular beads (4, 14).

9. The drinking straw according to claim 4, and wherein said inner diameter of said closure cap only as adjoining said cap bottom corresponds approximately to the outer diameter of said drinking straw opening.

* * * * *